US006793464B2

(12) United States Patent
Murakami et al.

(10) Patent No.: US 6,793,464 B2
(45) Date of Patent: Sep. 21, 2004

(54) MOTOR-DRIVEN COMPRESSOR COOLED BY REFRIGERANT GAS

(75) Inventors: Kazuo Murakami, Kariya (JP); Yoshiyuki Nakane, Kariya (JP); Susumu Tarao, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 505 days.

(21) Appl. No.: 09/765,155

(22) Filed: Jan. 17, 2001

(65) Prior Publication Data

US 2001/0014289 A1 Aug. 16, 2001

(30) Foreign Application Priority Data

Jan. 18, 2000 (JP) ..... 2000-009254

(51) Int. Cl.[7] ..... F04B 1/26; F04B 49/00

(52) U.S. Cl. ..... 417/269; 417/222.2

(58) Field of Search ..... 417/269, 270, 417/271, 272, 273, 321, 222.2; 91/472; 92/12.1, 12.2

(56) References Cited

U.S. PATENT DOCUMENTS 3,934,967 A 1/1976 Gannaway ..... 417/271
5,988,798 A * 11/1999 Hirasawa et al. ..... 347/65
6,514,048 B2 * 2/2003 Makino et al. ..... 417/222.2
6,532,858 B2 * 3/2003 Fujii et al. ..... 92/71
6,568,913 B1 * 5/2003 Strikis et al. ..... 417/199.1
6,589,022 B2 * 7/2003 Yokomachi et al. ..... 417/222.2
6,629,823 B2 * 10/2003 Ota et al. ..... 417/222.1

FOREIGN PATENT DOCUMENTS

| | | | |
|---|---|---|---|
| DE | 24 36 407 B2 | 2/1976 | ..... F25B/1/02 |
| EP | 0 978 653 A2 | 2/2000 | ..... F04B/35/00 |
| JP | 5-187356 | 7/1993 | ..... F04B/27/08 |
| JP | 9-32729 | 2/1997 | ..... F04B/39/06 |

* cited by examiner

*Primary Examiner*—Daniel Robinson
(74) *Attorney, Agent, or Firm*—Morgan & Finnegan, LLP

(57) ABSTRACT

A compressor includes a housing that has cylinder bores. A swash plate chamber communicates to the cylinder bores and a motor chamber partitioned from the swash plate chamber. A motor is disposed in the motor chamber actuates a drive mechanism in the swash plate chamber so as to move pistons in the cylinder bores. The refrigerant gas is supplied to an interior refrigerant passage of the compressor from an external refrigerant circuit. The swash plate chamber and the motor chamber are separated in the air tight manner. The motor chamber is connected to the interior refrigerant passage by a refrigerant path.

13 Claims, 6 Drawing Sheets

MOTOR-DRIVEN COMPRESSOR COOLED BY REFRIGERANT GAS

BACKGROUND OF THE INVENTION

This invention relates to a motor-driven compressor and, more particularly, to a motor driven compressor for an air conditioning system where the compressor is cooled by refrigerant gas.

In the prior art, a compressor is usually incorporated in an automotive air conditioning system, and it is known to employ a motor-driven compressor in an automotive air conditioner.

Such a compressor is disclosed in Japanese Patent Provisional Publications No. 5-187356. This compressor is a swash type compressor that includes an electric motor and a refrigerant compressing device in a common housing. The electric motor is located in one part of the internal space of the housing, and the refrigerant compressing device is received in the remaining part of the housing. The electric motor and the refrigerant compressing device are arranged in the housing in a tandem relationship. The refrigerant compressing device includes cylinder bores, pistons located in the respective cylinder bores, a drive shaft and a swash plate coupled to the drive shaft for converting a rotational motion of the drive shaft to linear piston motion. A portion of the drive shaft supports a rotor of the electric motor. When the pistons slide within the cylinder bores, refrigerant is drawn into the cylinder bores. Compressed refrigerant is exhausted into an exhaust chamber. The electric motor is cooled by blow-by gases exhausted in an inner part of the housing and by heat dissipation through the walls of the housing. However, when the electric motor generates a large quantity of heat, the electric motor is not sufficiently cooled, which reduces a magnetic flux in the electric motor and reduces the motor's efficiency.

Japanese Patent Provisional Publication No. 9-32729 discloses a scroll type compressor driven by an electric motor. In such a compressor, the electric motor and a refrigerant compressing device are located in first and second chambers of a common housing. Although the common housing has a partition wall between the electric motor and the refrigerant compressing device, the first and second chambers communicate with each other through a passage formed in the partition wall. An intake port is formed in the first chamber, and an exhaust port is formed in the second chamber. When the refrigerant compressing device is driven by the electric motor, refrigerant is drawn from the intake port into the refrigerant compressing device through the electric motor and the passage formed in the partition wall, compressed by the refrigerant compressing device, and exhausted from the exhaust port. The electric motor is cooled by refrigerant passing through a space between a stator and a rotor of the electric motor. In such a compressor, however, if the electric motor generates a large quantity of heat if the electric motor is operating under a high load, the temperature of the refrigerant becomes high with a resultant decrease in the compression efficiency.

SUMMARY OF THE INVENTION

It is an object of the present invention to provide a compressor that can effectively cool an electric motor in a highly reliable manner.

To achieve the above and other object, the present invention provides a compressor having an interior refrigerant passage. The refrigerant gas is supplied to the interior refrigerant passage from an external refrigerant circuit. The compressor comprises a housing, a cylinder bore disposed in the housing. A first chamber is disposed in the housing and communicates to the cylinder bore. A second chamber is disposed in the housing. The second chamber is partitioned from the first chamber in an air tight manner. A piston is movably located in the cylinder bore. A drive mechanism is disposed in the first chamber to move the piston. A motor is disposed in the second chamber to drive the drive mechanism. A refrigerant path connects the second chamber with the interior refrigerant passage.

Other aspect and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
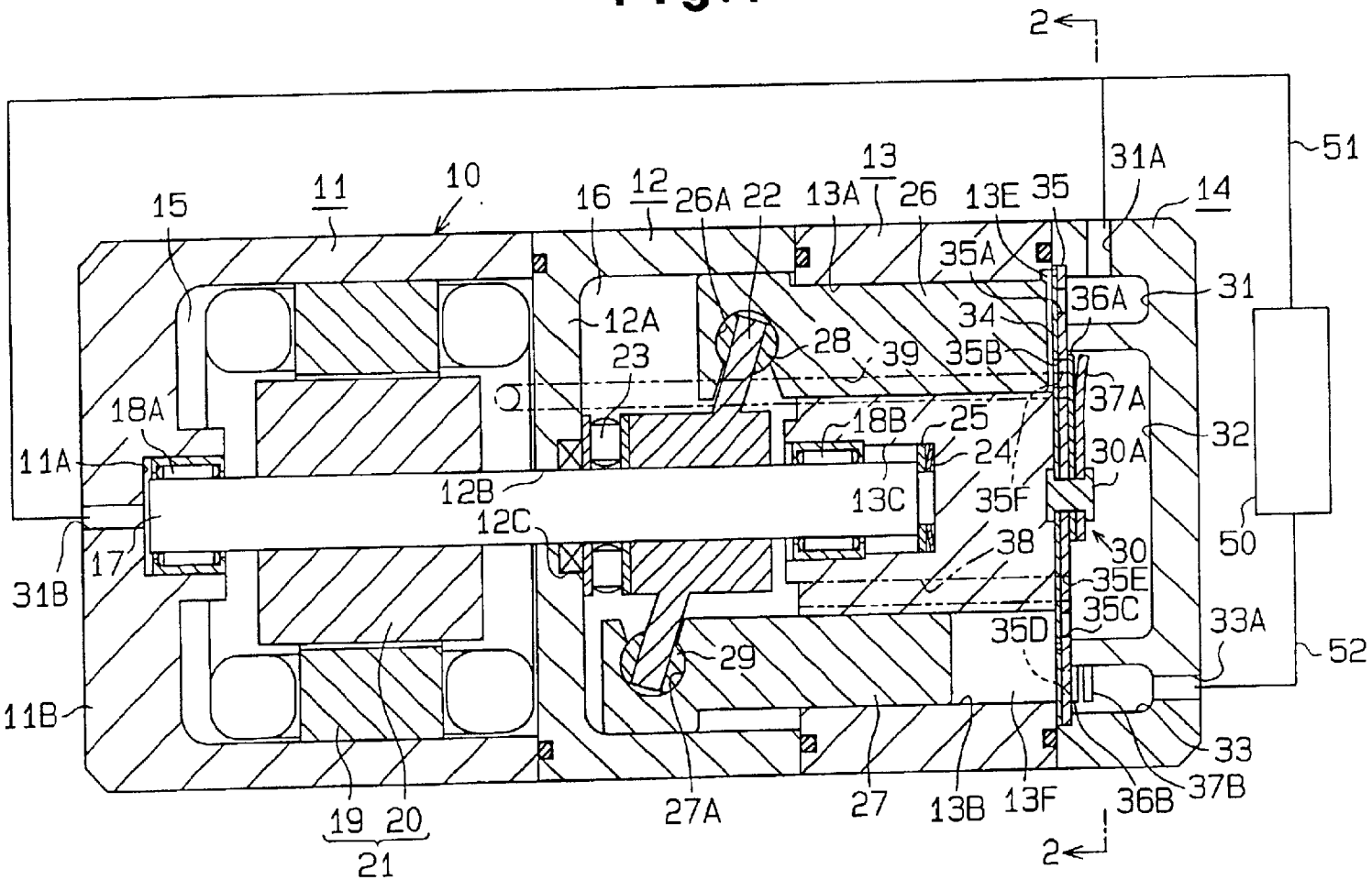
FIG. 1 is a cross sectional view of a first preferred embodiment of a compressor according to the present invention.
Figure 2:
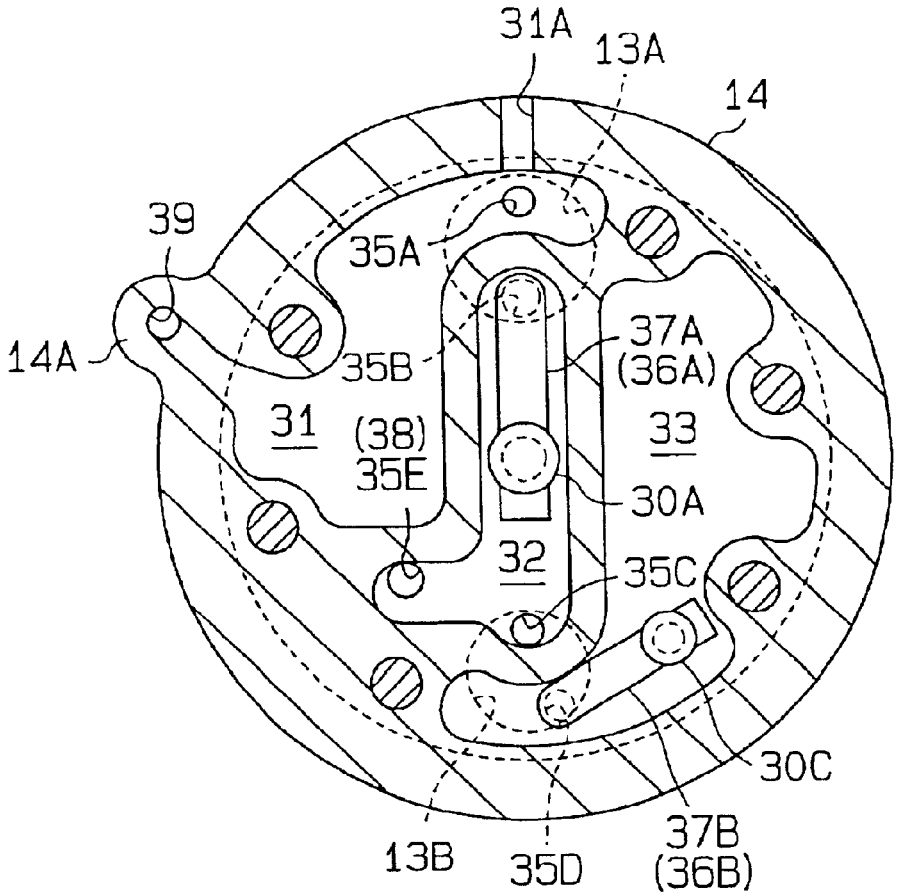
FIG. 2 is a cross sectional view taken along line 2—2 of FIG. 1.

Referring now to the drawings, FIGS. 1 and 2 show a preferred embodiment of a compressor according to the present invention.

As shown in FIG. 1, the compressor includes a housing 10. The housing 10 includes a motor housing component 11, a front housing component 12, cylinder block 13 and a rear housing component 14. The components 11, 12, 14 and the cylinder block 13 are aligned along an axis of the compressor, and they are coupled to one another by a plurality of connecting rods (not shown), and adjacent components are sealed with an "O" ring. An inner part of the motor housing component 11 has a motor chamber 15, and an inner part of the front housing component 12 has a swash plate chamber 16. The motor chamber 15 and the swash plate chamber 16 are separated by a partition wall 12A of the front housing component 12.

An electric motor 21 is incorporated in the motor chamber 15, and a refrigerant compressing device is incorporated in the front housing component 12, the cylinder block 13 and the rear housing components 14 such that a part of the compressing device is exposed to the swash plate chamber 16. The refrigerant compressing device includes first and second cylinder bores 13A, 13B, first and second pistons 26, 27, a valve unit 30, an intake chamber 31, an exhaust chamber 33, an intermediate pressure chamber 32, a drive shaft 17 and a swash plate 22.

The drive shaft 17 and the swash plate 22 form a drive mechanism of the refrigerant compressor device. The drive shaft 17 extends through the partition wall 12A of the front housing component 12. One end of the drive shaft 17 is supported by an end wall 11B of the motor housing component 11, and the other end of the drive shaft 17 is supported by the cylinder block 13. More specifically, the drive shaft 17 is held at one end by a radial bearing 18A located in the end wall 11B of the motor housing component 11. The other end is held by a radial bearing 18B located in a cavity 13C of the cylinder block 13. An axial seal 12C is located in the end wall 12A to seal between a through-bore of the end wall 12A and the drive shaft 17, which prevents leakage of compressed refrigerant between the motor chamber 15 and the swash plate chamber 15.

The electric motor 21 includes a stator 19 and a rotor 20. The stator 19 is fixed to the motor housing component 11, and the rotor 20 is fixed to the drive shaft 17.

The swash plate 22 is located in the swash plate chamber 16. The swash plate 22 is fixed to the drive shaft 17. A thrust bearing 23 is placed between the swash plate 22 and the end wall 12A of the front housing component 12. One of the drive shaft 17 extends in the cylinder block 13 and is urged toward the electric motor 21 by a dish spring 24. A spring seat is located in the cavity 13C of the cylinder block 13. The drive shaft 17 is positioned in the axial direction by the thrust bearing 23 and the dish spring 24.

The cylinder block 13 has a first cylinder bore 13A and a second cylinder bore 13B. The second cylinder bore 13B is smaller in diameter than the first cylinder bore 13A. The cylinder bores 13A and 13B are formed in the cylinder block 13 in a symmetrical relationship relative to the rotational axis of the drive shaft 17 and are angularly spaced from one another by 180 degrees. The cylinder bores 13A and 13B accommodate first and second pistons 26, 27, respectively. The cylinder bores 13A and 13B have compression chambers 13E, 13F, the volumes of which vary in dependence on the stroke of the pistons 26, 27. The ends of the pistons 26, 27 have concave portions 26A, 27A, which accommodate pairs of engaging shoes 28, 29, respectively. The peripheral edge of the swash plate 22 is held between the shoes 28, 29 of each pair. Consequently, when the drive shaft 17 rotates, the swash plate 22 rotates with the drive shaft 17, which causes the pistons 26, 27 to reciprocate. Each of the pistons 26, 27 has a stroke defined by the inclined angle of the swash plate 22. In the compressor shown in FIG. 1, as the swash plate 22 rotates, the upper piston 26 slides (as viewed in FIG. 1) from a top dead center position, which is shown in FIG. 1, toward a bottom dead center position, and the other piston 27 slides from the bottom dead center position, which is shown in FIG. 1, toward the top dead center position.

The rear housing component 14 forms the intake chamber 31, the intermediate pressure chamber 32 and the exhaust chamber 33. The intake chamber 31, the exhaust chamber 33 and the intermediate pressure chamber 32 communicate with the cylinder bore 13A, the cylinder bore 13B, and the cylinder bores 13A and 13B, respectively, through a valve unit 30.

An external refrigerant circuit 50 includes a condenser, an expansion valve and an evaporator and forms part of a refrigerant circuit with the compressor. The intake chamber 31 is connected through a downstream conduit 51 to an outlet of the evaporator, and the exhaust chamber 33 is connected through an upstream conduit 52 to an inlet of the condenser. An intake port 31A and an exhaust port 33A are formed in the rear housing component 14 in communication with the intake chamber 31 and the exhaust chamber 33, respectively. The downstream conduit 51 communicates through the intake port 31A with the intake chamber 31, and the upstream conduit 52 communicates through the exhaust port 33A with the exhaust chamber 33.

The valve unit 30 is located between the cylinder block 13 and the rear housing component 14. The valve unit 30 has an intake valve forming member 34 and a port forming member 35.

As shown in FIG. 2, the port forming member 35 has ports 35A, 35B, 35C and 35D. The port 35A communicates with the intake chamber 31 and the cylinder bore 13A, and the port 35B communicates with the cylinder bore 13A and the intermediate pressure chamber 32. The port 35C communicates with the intermediate pressure chamber 32 and the cylinder bore 13B, and the port 35D communicates with the cylinder bore 13B and the exhaust chamber 33. A port 35E communicates with a communication passage 38, and a cooling passage 39 communicates with the intermediate chamber 32 and the swash plate chamber 16. The intake valve forming member 34 has intake valves to open or close the ports 35A, 35C. The intake valves that open or close the ports 35B, 35D include first and second leaf valves 36A, 36B, respectively. The first leaf valve 36A is supported by a retainer 37A to open or close the port 35B and is connected to the intake valve forming member 34 and the port forming member 35 by a pin 30A. The second leaf valve 36B is supported by a retainer 37B to open or close the port 35D and is connected to the intake valve forming member 34 and the port forming member 35.

In FIG. 1, the compressor also includes a cooling circuit for cooling the electric motor 21. The cooling circuit includes a conduit 51A, which branches from the downstream conduit 51, and a cooling passage 39, which extends between the motor chamber 15 and the intake chamber 31. As best seen in FIG. 2, the cooling passage 39 is formed in a projection 14A protruding from the outer surface of the rear housing component 14. The projection 14A is integrally formed with the rear housing component 14. The cylinder block 13 and the front housing component 12 also have a projection contiguous with the projection 14A of the rear housing component 14. The projection of the cylinder block 13 and the front housing component 12 is parallel to the drive shaft 17. Further, the outer surface of the front housing component 11 has a projection contiguous with the projections of the cylinder block 13 and the front housing component 12. The cooling passage 39 extends through these projections and communicates at one end with the motor chamber 15 and at the other end with the intake chamber 31.

The end wall 11B of the motor housing component 11 has an intake port 31B. The intake port 31B communicates with a cavity 11A. The conduit 51A is connected through the intake port 31B with the motor chamber 15.

The operation of the compressor will now be described in a case where the refrigerant includes a mixture of carbon dioxide and lubricating oil.

When the electric motor 21 rotates the drive shaft 17, the swash plate 22 rotates with the drive shaft 17. When this occurs, the pistons 26, 27 reciprocate in the cylinder bores 13E, 13F, respectively. Due to the reciprocating motion of the piston 26, the volumes of the compression chambers 13E, 13F vary, thereby repeatedly drawings, compressing and exhausting the refrigerant in a sequential manner.

When the first piston 26 moves toward the bottom dead center position, the refrigerant flowing from the outlet of the evaporator of the refrigerant circuit 50 is drawn into the compression chamber 13E through the intake chamber 31 and the port 35A. When the first piston 26 moves toward the top dead center position, the refrigerant is compressed in the compression chamber 13E. The compressed refrigerant is then exhausted to the intermediate pressure chamber 32 through the leaf valve 36A and the port 35B.

At this instant, since the second piston 27 begins to move toward the bottom dead center position, some of the refrigerant exhausted to the intermediate pressure chamber 32 is drawn into the second compression chamber 13F through the port 35C. As the second piston 27 moves toward the top dead center position, the refrigerant in the second compression chamber 13F is re-compressed. The compressed refrigerant is exhausted to the exhaust chamber 33 through the leaf valve 36B and the port 35D. The compressed refrigerant is then delivered to the condenser of the refrigerant circuit 50 through the exhaust port 33A and the conduit upstream 52.

The reminder of the refrigerant in the intermediate pressure chamber 32 flows into the swash plate chamber 16 through the port 35E and the communication passage 38. Thus, the pressure in the swash plate chamber 16 equals that of the intermediate pressure chamber 32. The radial bearing 18B is lubricated with lubricating oil flowing into the swash plate chamber 16 with the refrigerant.

On the other hand, evaporated refrigerant in the conduit 51 delivered from the outlet of the evaporator of the refrigerant circuit 50 flows into the intake port 31B through the conduit 51A. This evaporated refrigerant flows into the motor chamber 15 through a space between inner and outer races of the radial bearing 18A. When this happens, the radial bearing 18A is lubricated with lubricating oil that is dispersed in mist form in the refrigerant.

Further, the refrigerant in the motor chamber 15 flows through a space between the stator 19 and the rotor 20, thereby cooling the electric motor 21. Subsequently, the refrigerant flows through the cooling passage 39 into the intake chamber 31. Then, the refrigerant is drawn into the compression chamber 13E, together with refrigerant that entered the intake chamber 31 through the downstream conduit 51, and is compressed.

The compressor of the present invention provides numerous advantages over the prior art compressors as discussed below.

Some evaporated refrigerant flowing from the outlet of the evaporator of the refrigerant circuit 50 is delivered to the motor chamber 15, which cools the electric motor 21. As a result, even when the compressor is driven at a high speed and the electric motor 21 is operating under high load, the temperature of the electric motor 21 is limited, and a reduction in the magnetic flux of the electric motor 21 due to high temperatures is avoided.

The refrigerant in the intermediate pressure chamber 32 flows into the swash plate chamber 16 such that the pressure in the swash plate chamber 16 is maintained at an intermediate pressure that is equal to that of the intermediate pressure chamber 32. That is, the pressure acting on the head of the piston 26 is nearly equal to that acting on the opposite end of the piston 26. Accordingly, the pressure difference acting on opposing ends of the pistons 26, 27 is minimum in the course of the exhausting step, in which the pistons 26, 27 operate under the highest load, which reduces forces and friction acting on various parts such as the pistons 26, 27, the shoes 28, 29, the swash plate 22, the drive shaft 17 and the thrust bearing 23. This extends the life of the compressor and reduces noises. Also, the amount of blow-by gas is decreased, which improves the compressing performance.

During the intake stroke of the first piston 26, the compression chamber 13E draws a mixture of refrigerant directly introduced to the intake chamber 31 through the intake port 31A and refrigerant that entered the intake chamber 31 after passing through the intake port 31B and the motor chamber 15. That is, refrigerant that is heated in the motor chamber 15 is mixed with refrigerant directly drawn from the refrigerant circuit 50, which has a low temperature. Accordingly, the compression chamber 13E is filled with the refrigerant having a small specific volume, which improves efficiency.

The seal member 12C seals between the bore 12B and the drive shaft 17 such that refrigerant does not flow between the motor chamber 15 and the swash plate chamber 16. This improves the performance of the compressor.

The refrigerant that enters the intake port 31B flows through spaces between the inner and outer races of the thrust bearing 18A into the motor chamber 15, thereby cooling the thrust bearing 18A while lubricating the thrust bearing 18A with lubricating oil in mist form, which is carried by the refrigerant. As a result, the life of the bearing is extended.

The refrigerant that enters the motor chamber 15 through the intake port 31B passes through the space between the stator 19 and the rotor 20, and cools a large area of the electric motor 21 in a highly reliable manner.

Figure 3:
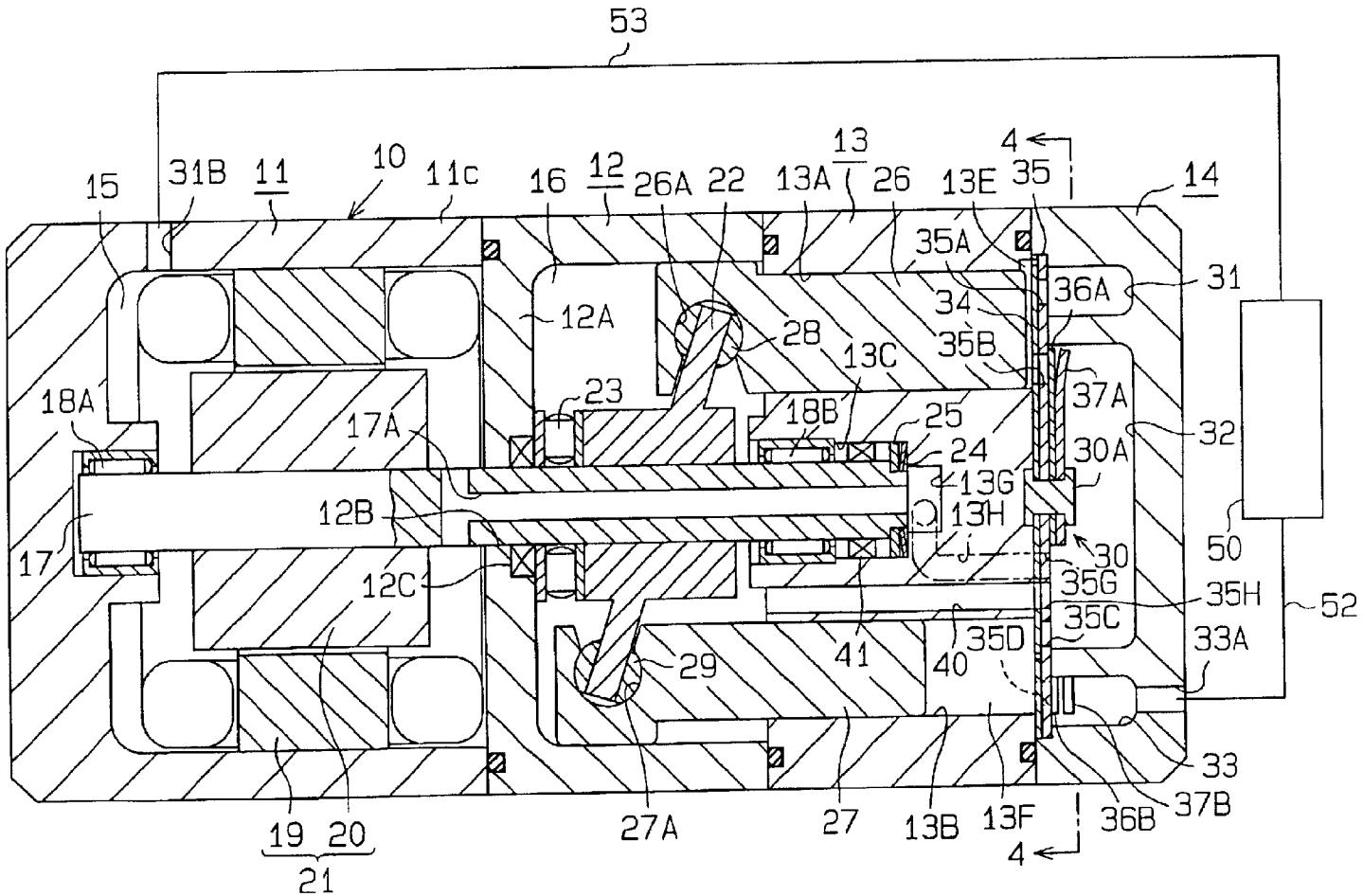
FIG. 3 is a cross sectional view of another preferred embodiment of a compressor according to the present invention.
Figure 4:
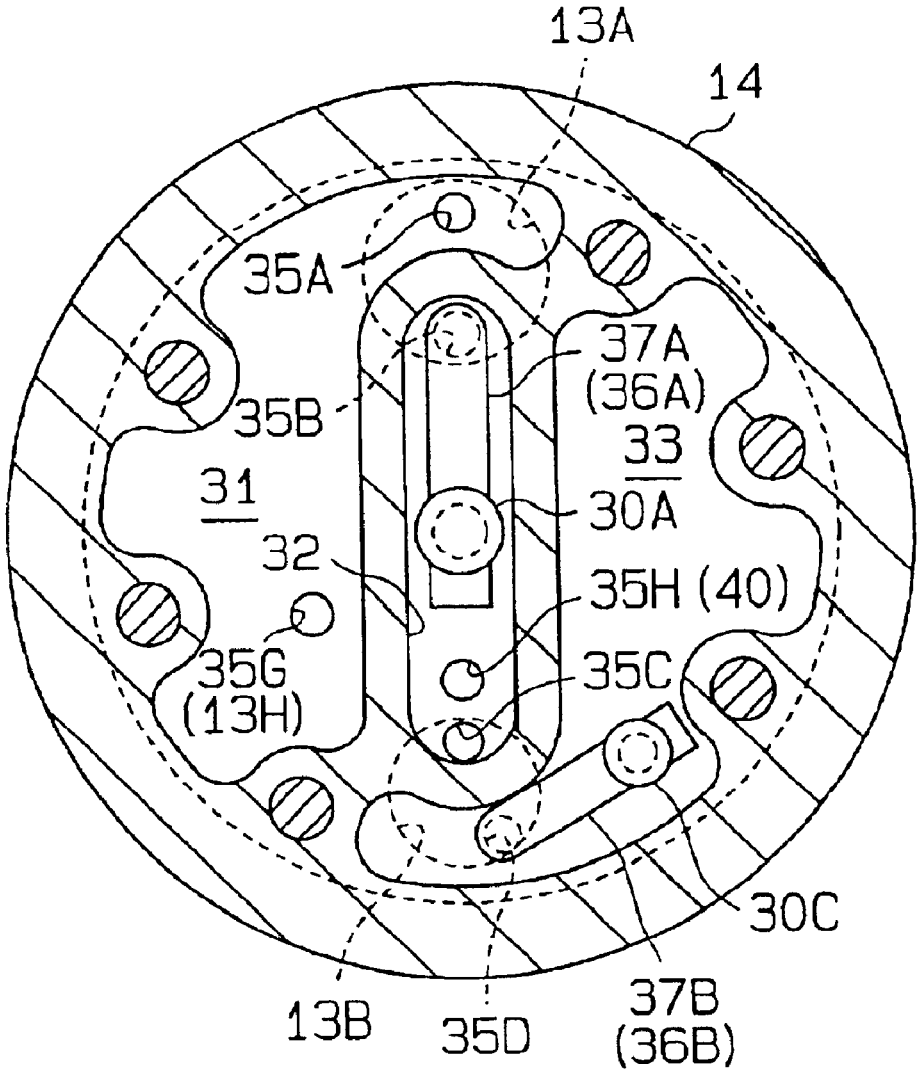
FIG. 4 is cross sectional view taken along line 4—4 of FIG. 3.

Another preferred embodiment of a compressor according to the present invention is shown in FIGS. 3 and 4, and like parts bear the same reference numerals as those used in FIGS. 1 and 2.

In this preferred embodiment, the compressor is a swash type multi-stage compressor for use in a refrigerant circuit that uses refrigerant mixed with carbon dioxide. All the evaporated refrigerant flowing from the extended refrigerant circuit is initially delivered to a motor chamber and is subsequently compressed.

A housing 10 includes a motor housing component 11, a front housing component 12, a cylinder block 13 and a rear housing component 14. A motor chamber 15 is formed in the motor housing component 11, and a swash plate chamber 16 is formed in the front housing component 12. The motor chamber 15 and the swash plate chamber 16 are separated from one another by an end wall 12A. An electric motor 21 is accommodated in the motor chamber 21, and a compressing device is accommodated in the front housing component 12.

The compressing device includes a cylinder 13A, a cylinder bore 13B, pistons 26, 27, which are located in the cylinder bores 13A, 13B, respectively, a drive mechanism, which includes a drive shaft 17 and a swash plate 22 fixed on the drive shaft 22, an intake chamber 31, which is connected with the cylinder bore 13A, an exhaust chamber 33, which is connected with the cylinder bore 13B, an intermediate chamber 32, which is connected with both the cylinder bores, and a valve unit 30, which includes ports and valves for permitting compressed refrigerant to flow into the cylinder bore 13B through the intermediate pressure chamber 32 and for permitting re-compressed refrigerant to flow into the exhaust chamber 33.

The exhaust port 33A is formed in the rear housing component 14 and communicates with the exhaust chamber 33. The intake port 31B is formed in a peripheral wall of the motor housing component 11. The electric motor 21 includes a stator 19 and a rotor 20. The stator 19 is fixed to the motor housing component 11. The rotor 20 is carried by the drive shaft 17 in the motor chamber 15.

In such a compressor, all the refrigerant flowing from the external refrigerant circuit 50 is delivered to the motor chamber 15 and, thereafter, the refrigerant is compressed by the pistons 26, 27. Then, the compressed refrigerant is exhausted into the external refrigerant circuit 50. To this end, the outlet side of the evaporator of the circuit 50 is connected with the motor chamber 15 through the conduit 51 and the intake port 31B. An inlet of the condenser of the external refrigerant circuit 50 is connected with the exhaust chamber 33 through the conduit 52.

Also, the motor chamber 15 is connected with the intake chamber 31 through the drive shaft 17 and a passage formed in the cylinder block 13. The motor chamber 15 and the intake chamber 31 are connected with each other through a passage including a communication bore 17A, a relay chamber 13G and a communication bore 13H. One end of the communication bore 17A opens to the motor chamber 15. The other end of the communication bore 17A opens to the relay chamber 13G of the cylinder block 13. The relay chamber 13G is formed in the cylinder block 13 and is contiguous with a cavity 13*c*, into which one end of the drive shaft 17 extends. Further, the cylinder block 13 includes the communication bore 13H, which is connected to the relay chamber 13G. One end of the communication bore 13H opens to the relay chamber 13G, and the other end of the communication bore 13H opens, through a port 35G of a port forming member 35, to the intake chamber 31 as shown in FIG. 4. A seal 41 is located between the cavity 13C and the drive shaft 17, which seals between the cavity 13C and the swash plate chamber 17.

As shown in FIG. 3, the cylinder block 13 also includes the communication bore 40. One end of the communication bore 40 opens to the swash plate chamber 16, and the other end of the communication bore 40 communicates with the intermediate pressure chamber 32 through a port 35H, which is formed in the port forming member 35.

In operation, when the electric motor 21 is turned on, the swash plate 22 rotates and the pistons 26, 27 reciprocate. When this occurs, the refrigerant in the external refrigerant circuit 50 is drawn into the motor chamber 15 through the conduit 53 and the intake port 31. The refrigerant in the motor chamber 15 flows through the space between the stator 19 and the rotor 20 of the electric motor 21 into the communication bore 17A, from which the refrigerant flows through the relay chamber 13G, the communication bore 13H, and the port 35G into the intake chamber 31. Since the refrigerant is delivered to the relay chamber 13G before it is compressed, the pressure in the relay chamber 13G is lower than that of the swash plate chamber 16. The seal 41 prevents leakage of the refrigerant into the relay chamber 13G from the swash plate chamber 16 due to the pressure difference between the relay chamber 13G and the swash plate chamber 16.

The refrigerant in the intake chamber 31 is conducted into the first cylinder bore 13A through the port 35A and is compressed. The compressed refrigerant is then delivered to the intermediate pressure chamber 32 through the port 35B. Then, refrigerant flows through the port 35C into the cylinder bore 13B and is re-compressed. The re-compressed refrigerant is exhausted through the port 35D into the exhaust chamber 33. The exhausted refrigerant is delivered to the condenser of the external refrigerant circuit 50 through the conduit 52.

As seen in FIG. 3, since some of the refrigerant in the intermediate pressure chamber 32 flows into the swash plate chamber 16 through the port 35H and the communication bore 40, the swash plate chamber 16 has a pressure nearly equal to that of the intermediate pressure chamber 32. The radial bearing 18B is lubricated with the lubricating oil contained in the refrigerant that flows to the swash plate chamber 16.

In the compressor discussed above, since the motor chamber 15 is supplied with evaporated refrigerant, which is low in temperature and is not compressed by the pistons 26, 27, from the external refrigerant circuit 50, the electric motor 21 is cooled.

Further, since the swash plate chamber 16 has the intermediate pressure, which is nearly equal to that of the intermediate pressure chamber 32, and since there is a minimum pressure difference between the fronts and backs of the pistons 26, 27 during the exhausting stroke, in which the pistons are under the maximum load, forces and friction acting on parts such as the pistons 26, 27, the shoes 28, 29, the swash plate 16, the drive shaft 17, and the thrust bearing 23 are reduced, which extends the life of the compressor and reduces noise. Since the amount of blow-by gases decreases, the compressor has a higher compression efficiency.

Since, further, the seal 12C seals the space between the bore 12B and the drive shaft 17, the refrigerant is prevented from leaking to the motor chamber 15 from the swash plate chamber 16, which increases the compression efficiency.

Since the refrigerant in the motor chamber 15 passes through the space between the inner periphery of the stator 19 and the outer periphery of the rotor 20, a large area of the electric motor 21 is cooled.

Figure 5:
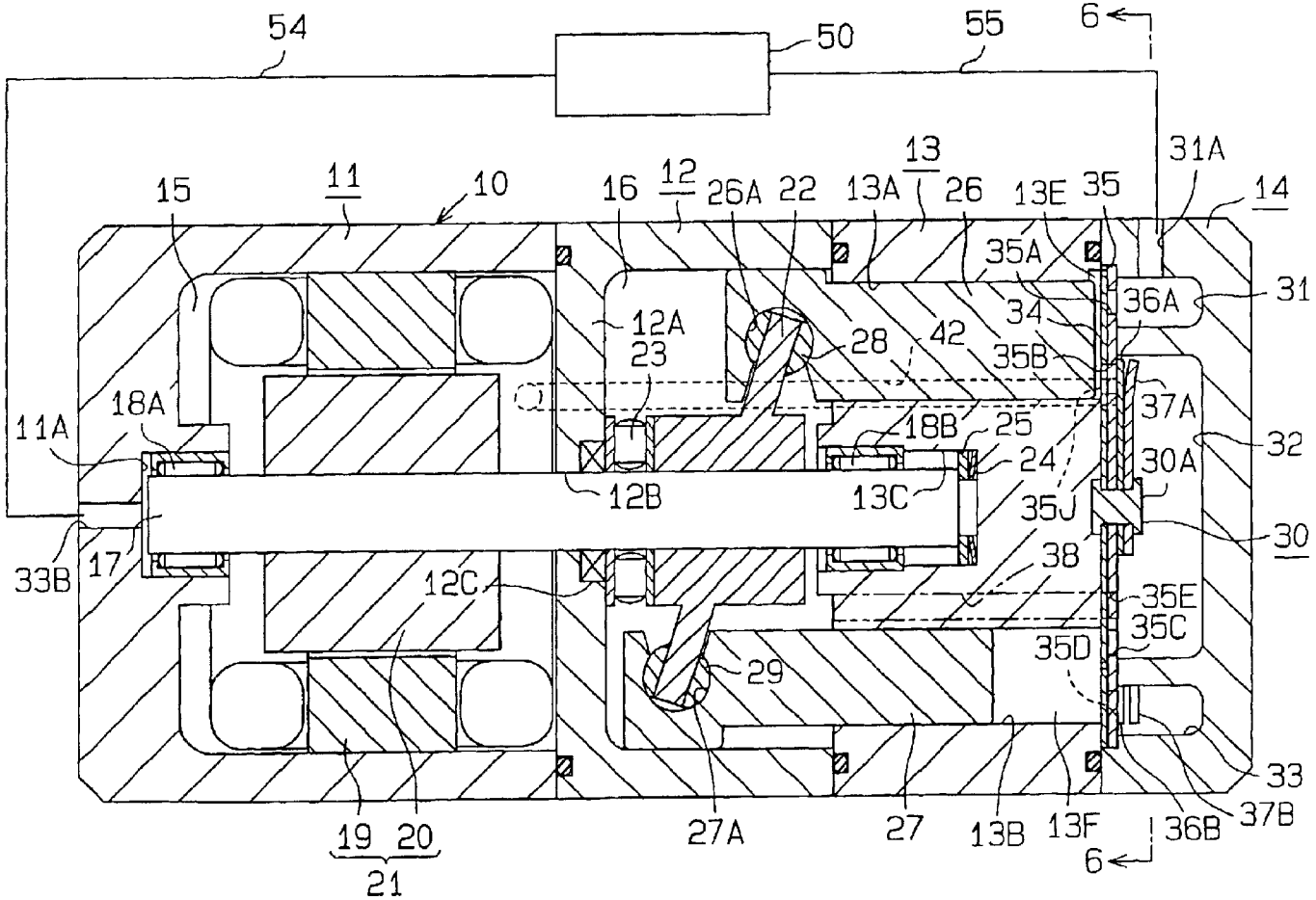
FIG. 5 is a cross sectional view of a third preferred embodiment of a compressor according to the present invention.
Figure 6:
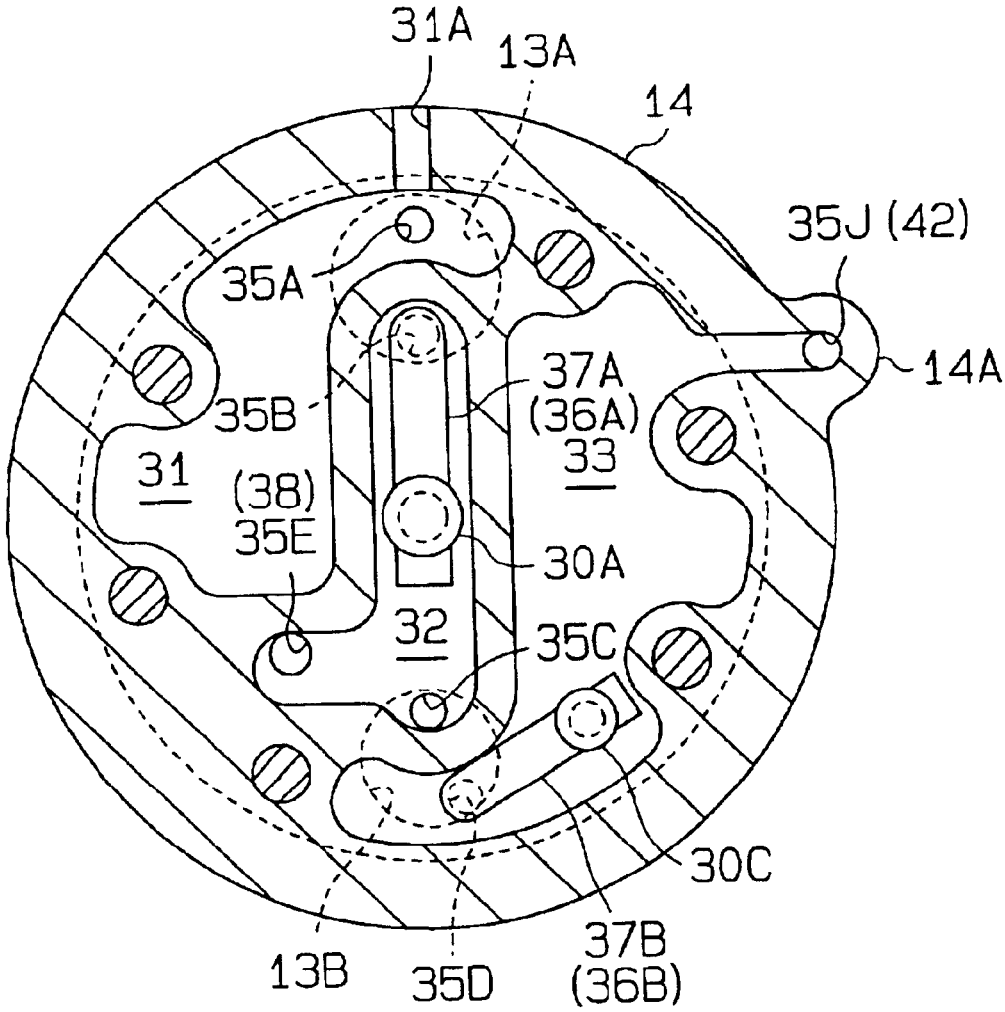
FIG. 6 is a cross sectional view taken along line 6—6 of FIG. 5.

A further alternative preferred embodiment of a compressor according to the present invention is shown in FIGS. 5 and 6, and like parts bear the like reference numerals as those used in FIGS. 1 and 2.

In this alternative embodiment, the compressor is a swash type multi-stage compressor for use in a refrigerant circuit that uses refrigerant mixed with carbon dioxide. All the evaporated refrigerant flowing from the external refrigerant circuit is initially compressed by a refrigerant compressor, and is delivered to a motor chamber.

A housing 10 includes a motor housing component 11, a front housing component 12, a cylinder block 13 and a rear housing component 14. A motor chamber 15 is formed in the motor housing component 11, and a swash plate chamber 16 is formed in the front housing component 12. The motor chamber 15 and the swash plate chamber 16 are separated from one another by an end wall 12A. An electric motor 21 is located in the motor chamber 21, and a compressing device is accommodated in the front housing component 12. The cylinder block 13 and the rear housing component 14 such that a part of a drive mechanism is exposed to the swash plate chamber 16.

The electric motor 21 includes a stator 19 and a rotor 20. The stator 19 is fixed to the motor housing component 11, and the rotor 20 is fixedly supported on the drive shaft 17.

The compressing device includes a cylinder 13A, a cylinder bore 13B, pistons 26, 27, which are located in the cylinder bores 13A, 13B, respectively, a drive mechanism, which includes a drive shaft 17 and a swash plate 22 fixed on the drive shaft 22, an intake chamber 31, which is connected with the cylinder bore 13A, an exhaust chamber 33, which is connected with the cylinder bore 13B, an intermediate chamber 32, which is connected with both the cylinder bores, and a valve unit 30, which includes ports and valves for permitting compressed refrigerant to flow into the cylinder bore 13A from the intake chamber 31 for permitting compressed refrigerant to flow into the cylinder bore 13B through the intermediate pressure chamber 32 to re-compress the refrigerant and subsequently introducing re-compressed refrigerant into the exhaust chamber 33. The intake port 31A is formed in the rear housing component 14, and is connected with the intake chamber 31, and the exhaust port 33B is formed in the motor housing component 11, and is connected with a cavity 11A that accommodates a bearing 18A.

The valve unit 30 includes an intake valve forming member 34 and a port forming member 35. The intake valve forming member 34 has intake valves to open or close the ports 35A, 35C. As seen in FIG. 6, the port forming member 35 has ports 35A, 35B, 35C, 35D, 35E, 35J. The port 35E is connected with a cooling passage 39, that communicates with the intermediate chamber 32 and the swash plate chamber 16 as shown in FIG. 5. The port 35J communicates with the exhaust chamber 33 and the passage 42.

The first and second leaf valves 36A and 36B are supported by retainers 37A, 37B to open or close the ports 35B, 35D and is connected to the intake valve forming member 34 and the port forming member 35, respectively, by pins 30A, 30B.

In the alternative embodiment of the compressor, the intake chamber 31 is connected with the external refrigerant circuit 50 through the intake port 31A and the conduit 56. The exhaust chamber 33 is connected with the motor chamber 15 through the passage 42. The motor chamber 15 is connected with an inlet of a condenser of the outer refrigerant circuit 50.

A passage 42 is connected with the exhaust chamber 33 and the motor chamber 15 is located outside of the housing 10 in the same manner as the compressor of the first preferred embodiment shown in FIGS. 1 and 2. The passage 42 extends through an outward projection 14A extending from the outer surface of the rear housing component 14, outward projections formed the outer surfaces of the cylinder block 13 and the front housing component 12, and an outward projection formed on the outer surface of the front housing component 11. One end of the passage 42 opens to the port 35J of the valve unit 30, and the other end of the passage 42 opens to one end of the motor chamber 15 adjacent the swash plate chamber 16.

In operation, when the electric motor 21 is turned on, the swash plate 22 rotates and the pistons 26, 27 reciprocate. When this occurs, refrigerant in the external refrigerant circuit 50 is drawn into the intake chamber 31 through the intake port 31A. As seen in FIG. 6, refrigerant is drawn through the port 35A into the cylinder bore 13A and is compressed therein. Compressed refrigerant is conducted through the port 35B and the first leaf valve 36A into the intermediate pressure chamber 32. Then, the compressed refrigerant is conducted into the cylinder bore 13B through the port 35C and is re-compressed. The re-compressed refrigerant is delivered through the port 35D and the second leaf valve 36B to the exhaust chamber 33. The compressed refrigerant is conducted through the port 35J and the passage 42 into the motor chamber 15. The refrigerant is delivered to the motor chamber 15 and flows through the space between the stator 19 and the rotor 20 and the space between the inner and outer races of the radial bearing 18A into the exhaust port 33B. Then, the refrigerant is returned to an inlet of the condenser of the external refrigerant circuit 50 through the conduit 54. Consequently, the radial bearing 18A is lubricated with the lubricating oil in mist form carried by the refrigerant.

As seen in FIG. 5, some of the refrigerant is conducted to the swash plate chamber 16 through the port 35E and the communication passage 38. When this occurs, the swash plate chamber 16 has an intermediate pressure, which is equal to that of the intermediate pressure chamber 32. The radial bearing 18B is lubricated with the lubricating oil carried by the refrigerant flowing to the swash plate chamber 16.

The compressor of the alternative embodiment of FIG. 5 provides the following advantages:

The electric motor 21 is cooled by the compressed refrigerant before is exhausted into the external refrigerant circuit 50. Since this compressed refrigerant is lower in temperature than the motor chamber 15, the electric motor 21 is cooled.

Since, the compressed refrigerant flows into the motor chamber 15 through the passage 42 that extends through the projection formed on the outer surface of the housing 10, the compressed refrigerant is cooled by outside air while passing through the passage 42 and cools the electric motor 21.

It should be apparent to those skilled in the art that the present invention may be embodied in many other forms without departing from the spirit or scope of the invention. Particularly, it should be understood that the invention may be embodied in the following forms.

In the illustrated embodiments, although the motor chamber 15 is cooled by either evaporated refrigerant, which is not compressed, or compressed refrigerant, after complete compression, the electric motor 21 may also be cooled by refrigerant having an intermediate pressure.

For, example, the compressor is arranged such that the motor chamber 15 communicates with a first intermediate pressure chamber that is connected with the intake and exhaust ports of one of the cylinder bores, and a second intermediate pressure chamber that is connected with the intake and exhaust ports of the other one of the cylinder bores. That is, the motor chamber 15 has a pressure that is equal to half of those of the first and second intermediate chambers. The swash plate chamber 16 is connected with the first intermediate pressure chambers through the communication bore. That is, the motor chamber 15 has a pressure at a level intermediate the pressure level of the first and second intermediate pressure chamber. On the other hand, the swash plate chamber 16 is connected with the first intermediate pressure chamber through another communication bore different from a passage that is connected with the both intermediate pressure chambers and the motor chamber 15.

In the compressor discussed above, since the intermediately pressurized refrigerant delivered to the first intermediate pressure chamber from the cylinder bore 13A passes through the motor chamber 15 into the second intermediate pressure chamber and is drawn into the cylinder bore 13B, the electric motor 21 is cooled. Further, since the intermediately pressurized refrigerant in the first intermediate pressure chamber is sent to the swash plate chamber 16, the pressure of the swash plate chamber 16 is intermediate such that there is only a small pressure difference between the front and back ends of the pistons 26, 27.

In the illustrated embodiments, although compressors have been shown and described as having one pair of cylinder bores, the compressor may have more than one pair of cylinder bores. Also, the compressor may be single stage compressor, in which the refrigerant is compressed once and exhausted.

In the illustrated embodiments, although the compressors have been described as a fixed volume type compressors with a fixed stroke, the compressors may be variable volume type compressors with a variable stroke.

In the illustrated embodiments of the compressors of FIGS. 1 and 2 and FIGS. 5 and 6, the intake port 31B is open at one end of the motor chamber 15 at a position opposite to the swash plate chamber 16, however, the intake port may be formed in another area to meet various design changes in the compressor's structure or the motor chamber, provided that the motor chamber 15 and the swash plate chamber 16 are completely isolated in pressure from one another. Likewise, in the illustrated embodiment of FIGS. 5 and 6, the exhaust port 33B may be formed in another area of the motor housing component 11.

In the illustrated embodiments, further, although single intake ports 31B and exhaust port 33B are employed in the compressors, the motor housing component 11 may have plural intake ports 31B and exhaust ports 33B if desired.

What is claimed is:

1. A compressor having an interior refrigerant passage, wherein the refrigerant gas is supplied to the interior refrigerant passage from an external refrigerant circuit, said compressor comprising:

a housing;

a cylinder bore disposed in the housing;

a first chamber disposed in the housing and communicating to the cylinder bore;

a second chamber disposed in the housing, said second chamber being partitioned from the first chamber in an air tight manner;

a piston movably located in the cylinder bore;

a drive mechanism disposed in the first chamber to move the piston;

a motor disposed in the second chamber to drive the drive mechanism; and a refrigerant path connecting the second chamber with the interior refrigerant passage, wherein the refrigerant path is formed in an internal area of the compressor.

2. The compressor according to claim 1, wherein the drive mechanism includes a drive shaft extending in the first chamber and the second chamber and a swash plate mounted on the drive shaft, wherein drive shaft has an end coupled to the motor in the second chamber, and wherein the swash plate is coupled to the piston to drive the piston with the torque of the motor.

3. The compressor according to claim 1, wherein the refrigerant gas introduced to the compressor is partially lead to the cylinder bore via the second chamber, the refrigerant path and the interior refrigerant passage.

4. The compressor according to claim 1, wherein the refrigerant gas introduced to the compressor is entirely lead to the cylinder bore via the second chamber, the refrigerant path and the interior refrigerant passage.

5. The compressor according to claim 1, wherein the refrigerant gas compressed in the compressor and directed toward the external refrigerant circuit is lead to the second chamber via the refrigerant passage.

6. A compressor for compressing refrigerant that is circulated in an external refrigerant circuit, wherein refrigerant is compressed, condensed, expanded and evaporated, the compressor comprising:

a housing having a first chamber and a second chamber, which are separated in an air tight manner;

a refrigerant compressing mechanism including a plurality of cylinder bores, said cylinder bores being arranged from an upstream position to a downstream position with respect to a flow direction of the refrigerant in the compressor, a plurality of pistons, each located in one of the cylinder bores, at least one intermediate chamber connecting two of the cylinder bores with each other, a suction chamber communicating with the most upstream cylinder bore, a discharge chamber communicating with the most downstream cylinder bore, and a drive mechanism located in the first chamber for driving the pistons;

an electric motor accommodated in the second chamber for driving the drive mechanism;

a first conduit for conducting refrigerant from the external refrigerant circuit to the second chamber;

a first refrigerant path for conducting refrigerant from the second chamber to the suction chamber; and a second conduit for conducting compressed refrigerant from the refrigerant compressing mechanism to the external refrigerant circuit.

7. The compressor according to claim 6, wherein the first refrigerant path has a first end that opens to the second chamber, and a second end that opens to the suction chamber, and wherein the drive mechanism includes a drive shaft extending between the first chamber and the second chamber.

8. The compressor according to claim 6, further comprising a third conduit for conducting the refrigerant to the suction chamber from the external refrigerant circuit.

9. The compressor according to claim 6, further comprising a second refrigerant path connecting the intermediate chamber with the second chamber.

10. The compressor according to claim 6, wherein the drive mechanism includes a drive shaft extending in the first chamber and the second chamber and a swash plate mounted on the drive shall, wherein drive shaft has an end coupled to the motor in the second chamber, and wherein the swash plate is coupled to the pistons to drive the pistons based on the torque of the motor.

11. The compressor according to claim 6, wherein the refrigerant gas introduced to the compressor is partially lead to the cylinder bore via the second chamber and the refrigerant paths.

12. The compressor according to claim 6, wherein the refrigerant gas introduced to the compressor is entirely lead to the cylinder bore via the second chamber and the refrigerant paths.

13. The compressor according to claim 1, wherein the refrigerant is directly introduced to the second chamber from an evaporator of the external refrigerant circuit.

* * * * *

UNITED STATES PATENT AND TRADEMARK OFFICE

CERTIFICATE OF CORRECTION

PATENT NO. : 6,793,464 B2
DATED : September 21, 2004
INVENTOR(S) : Murakami et al.

It is certified that error appears in the above-identified patent and that said Letters Patent is hereby corrected as shown below:

Column 4,
Line 63, please delete “repeatedly drawings,” and insert therefore -- repeatedly drawing, --;

Column 11,
Lines 44, 48, 51 and 53, please delete “lead” and insert therefore -- led --;

Column 12,
Line 47, please delete “lead” and insert therefore -- led --.

Signed and Sealed this

Twelfth Day of April, 2005

JON W. DUDAS
*Director of the United States Patent and Trademark Office*